US005513762A

United States Patent [19]

Janani

[11] Patent Number: 5,513,762

[45] Date of Patent: May 7, 1996

[54] DRINKING CONTAINER WITH RETRACTABLE DRINKING STRAW

[75] Inventor: Saeid Janani, East St. Louis, Ill.

[73] Assignee: Double J Company, Chesterfield, Mo.

[21] Appl. No.: 344,867

[22] Filed: Nov. 25, 1994

[51] Int. Cl.[6] ..... B65D 47/14

[52] U.S. Cl. ..... 215/229; 215/389; 215/306; 215/307; 220/709; 220/373; 220/375

[58] Field of Search ..... 215/388, 389, 215/229, 306, 307; 220/707, 708, 709, 373, 375

[56] References Cited

U.S. PATENT DOCUMENTS

| | | | |
|---|---|---|---|
| 2,066,121 | 12/1936 | Morris | 215/229 |
| 2,805,809 | 9/1957 | Pugh . | |
| 3,173,566 | 3/1965 | Talbert . | |
| 3,253,728 | 5/1966 | DePutron . | |
| 3,659,757 | 5/1972 | Tini . | |
| 3,776,458 | 12/1973 | Chunga, Sr. . | |
| 4,408,690 | 10/1983 | Ferrero . | |
| 4,448,316 | 5/1984 | Hiroshige . | |
| 4,684,032 | 8/1987 | Tsay . | |
| 4,925,040 | 5/1990 | Wang . | |
| 4,930,652 | 6/1990 | Murphy et al. . | |
| 4,966,300 | 10/1990 | Coonradt . | |
| 5,282,541 | 2/1994 | Chen . | |
| 5,337,918 | 8/1994 | Wang | 220/708 |
| 5,339,982 | 8/1994 | Tardie | 220/708 |
| 5,388,712 | 2/1995 | Brody | 215/229 |

*Primary Examiner*—Allan N. Shoap
*Assistant Examiner*—Stephen Cronin
*Attorney, Agent, or Firm*—Grace J. Fishel

[57] ABSTRACT

A drinking container such as a water bottle with a pair of telescoping straws, one of which is attached to a lid for the container and the other of which is threaded on a nut mounted on the lid for longitudinally sliding the second straw in the first straw when the nut is rotated and blocking an airway when the second straw is retracted.

7 Claims, 2 Drawing Sheets

DRINKING CONTAINER WITH RETRACTABLE DRINKING STRAW

BACKGROUND OF THE INVENTION

1. Field of the Invention

The present invention relates to a drinking container such as a water bottle with a pair of telescoping straws, one of which is attached to a lid for the container and the other of which is threaded on a nut mounted on the lid and retracted inside the first straw when the nut is rotated.

2. Brief Description of the Prior Art

Drinking containers with a straw passing though a lid are very popular with athletes and young people because the containers can be conveniently carried on a sports field, playground, camping trip and the like and may be filled, for example, with water, lemonade or other drinks which may be sipped through the straw without removing the lid from the container. Such containers, however, must be kept upright as the container will leak if it is tipped over, either at the straw or about the hole where the straw passes through the lid. The straw sticks out awkwardly and special carrying clips, brackets and the like have been developed for keeping the containers upright on a person, bicycle, etc.

A better drinking container would have a straw which could be retracted within the container, sealing the container as it retracts. Ideally, it would be easy to use and reliable. Various constructions have targeted this need, none of which have been entirely satisfactory. For example, U.S. Pat. No. 5,282,541 to Chen describes a water bottle with a straw and a spring loaded nipple which is relatively complicated and not easy to clean; U.S. Pat. No. 3,776,458 to Chunga, Sr. shows a spring loaded retractable straw that requires the user to push down on the straw with his fingers, contaminating the liquid in the container; U.S. Pat. No. 4,966,300 to Coonradt uses a stationary straw and a retractable straw popped up with an air pressure bulb, etc.

SUMMARY OF THE INVENTION

In view of the above, it is an object of the present invention to provide a drinking container with a telescoping drinking straw that is not manually pushed down with fingers and which can be easily fabricated from plastic. It is another object to provide a drinking container with a telescoping straw that does not leak so that the drinking container does not have to be kept upright. Other objects and features of the invention will be in part apparent and in part pointed out hereinafter.

In accordance with the invention, a drinking container having a lid with a rim lockably engaged at the rim to an open upper end of a vessel, is provided with a nut and first and second telescoping straws.

The nut has a head and a shank and the lid has top and bottom sides and an orifice within which the shank of the nut is journaled with the head of the nut mounted on the top side of the lid. The nut has a hole with threads passing through the shank and the head. The first straw is attached to the bottom side of the lid in alignment with the orifice and the second straw is smaller in diameter than the first straw. The second straw has exterior threads engaged with the threads in the hole of the nut such that when the nut on the lid is rotated, the second straw slides longitudinally in the first straw.

The invention summarized above comprises the constructions hereinafter described, the scope of the invention being indicated by the subjoined claims.

BRIEF DESCRIPTION OF THE DRAWINGS

In the accompanying drawings, in which two of various possible embodiments of the invention are illustrated, corresponding reference characters refer to corresponding parts throughout the several views of the drawings in which.

DETAILED DESCRIPTION OF THE INVENTION

Figure 1:
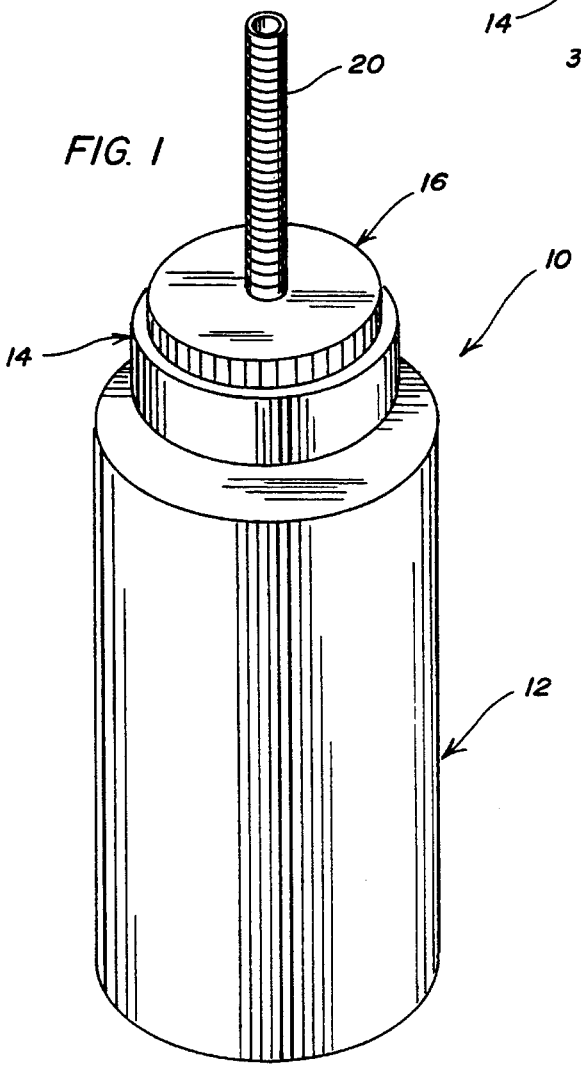
FIG. 1 is a perspective view of a drinking container in accordance with the present invention.
Figure 2:
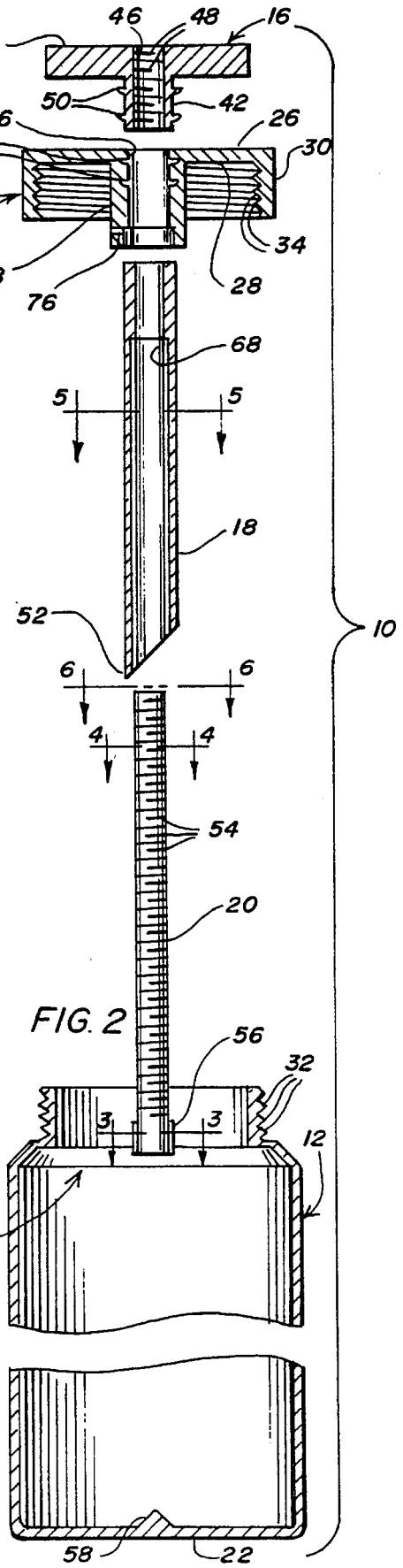
FIG. 2 is an exploded view in section of the drinking container.
Figure 6:
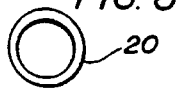
FIG. 6 is a section taken along line 6—6 in FIG. 2.

Referring to the drawings more particularly by reference character, reference numeral 10 refers to a drinking container in accordance with the present invention. Container 10 includes a vessel 12, a lid 14, a nut 16 and first and second telescoping straws 18, 20, respectively.

Vessel 12 has a closed lower end 22 and an open upper end 24 while lid 14 has top and bottom sides 26, 28, respectively and a rim 30. Lid 14 is lockably engaged at rim 30 to the open upper end of vessel 12 for sealing liquid within the vessel. As shown, open upper end 24 has exteriorly arranged threads 32 and rim 30 has interiorly arranged threads 34 that are adapted to engage the threads on the vessel. Lid 14 has an orifice 36, preferably centrally located, about which is attached a collar 38. In the form illustrated, collar 38 has an least one or more interior annular grooves 40. Nut 16 has a shank 42 and head 44 with a hole 46 with threads 48 that passes though the shank and the head. Shank 42 has at least one or more exterior ridges 50 received in groove(s) 40 of collar 38 when nut 16 is journaled in orifice 36 with head 44 on top side 26 of lid 14. The position of grooves 40 and ridges 50 may be reversed with grooves 40 on shank 42 and ridges 50 on collar 38.

First and second straws 18, 20, have top and bottom ends and a longitudinal axis with the top end of first straw 18 attached to bottom side 28 of lid 14 at collar 38 in alignment with orifice 36. The bottom end of first straw 18 reaches closed lower end 22 of vessel 12 and is preferably sloped at tip 52 to avoid making a seal. Second straw 20 is smaller in diameter than first straw and has exterior threads 54 engaged with threads 48 in hole 46 of nut 16 so that rotating the nut on the lid causes second straw 20 to slide longitudinally in first straw 18. In the form illustrated, the lower end of second straw 20 has an enlarged tip 56 and reaches closed lower end 22 of vessel 12 when second straw 20 is fully retracted within first straw 18. In retracted condition, tip 56 may be seated on an upstanding nub 58 provided on closed lower end 22 of vessel 12, sealing the end of the straw. An effective seal can be made without nub 58 if tip 56 is made of a deformable rubber or plastic material or if a rubber or plastic 0-ring or the like is provided in the end of tip 56. A plug 60 attached with a strap 62 to nut 16 or lid 14 may be provided for blocking the opposite end of second straw 20 at orifice 36.

Figure 3:
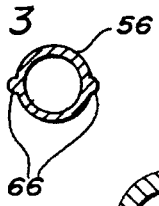
FIG. 3 is a section taken along line 3—3 in FIG. 2.
Figure 4:
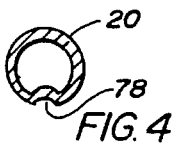
FIG. 4 is a section taken along line 4—4 in FIG. 2.
Figure 5:
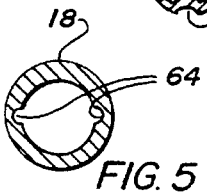
FIG. 5 is a section taken along line 5—5 in FIG. 2.

To keep second straw 20 from rotating with nut 16, first straw 18 has at least one or more longitudinal grooves 64 (FIG. 5) and second straw 20 has at least one or more lugs 66 formed on the exterior surface of tip 56 (FIG. 3) received in the longitudinal groove(s) of the first straw, which elements could of course be reversed. The inside diameter of first straw 18 is larger below its upper end to accommodate tip 56, forming an abutment shoulder 68 where it changes diameters. When tip 56 contacts shoulder 68, upward movement of second straw 20 is stopped, preventing the removal of second straw from drinking container 10. The fit between first and second straws 18, 20 above shoulder 68 is sufficiently air tight so that suction applied at the top end of the second straw is transmitted to tip 52 of first straw 18 and liquid drawn up through the straws.

As liquid is sipped through second straw 20, an airway 70 must be provided in lid 14 to avoid creating a vacuum in vessel 12. In order to ensure that any liquid contained within vessel 12 is not dripped out the airway when second straw 20 is retracted, airway 70 must be automatically blocked as the second straw is retracted. Two of various ways to accomplish this are shown in FIGS. 9–10 and FIGS. 2–8.

Figure 9:
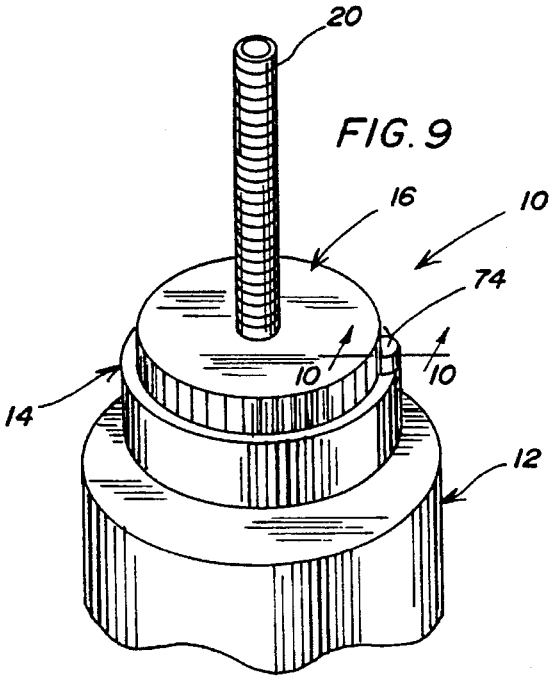
FIG. 9 is a fragmentary, perspective view of a second drinking container in accordance with the present invention illustrating a second airway; and, FIG. 10 is a section taken along line 10—10 in FIG. 9.
Figure 10:
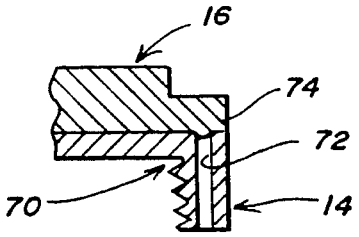

Turning first to FIGS. 9–10, a second orifice 72 is provided in lid 14 and head 44 is provided with a lobe 74 which overlies and blocks orifice 72 when second straw 20 is fully retracted. In the system shown in FIGS. 2–8, a port 76 is provided in the upper end of first straw 18 or, as shown, in collar 38. Second straw 20 has an exterior longitudinal groove 78 (FIG. 4), beginning a distance below its upper end. Port 76 is blocked by the sidewall (FIG. 6) of second straw 20 when the second straw is fully retracted, forming an air seal, and providing an airway when the port in the collar or in the first straw is aligned with the groove in the second straw.

Drinking container 10 can be inexpensively fabricated of plastic material, in whole or in part, for example of polyethylene, polypropylene, polystyrene or such other plastics as possess a natural slippery or sliding characteristic to permit first and second straws 18, 20 to telescope.

Figure 7:
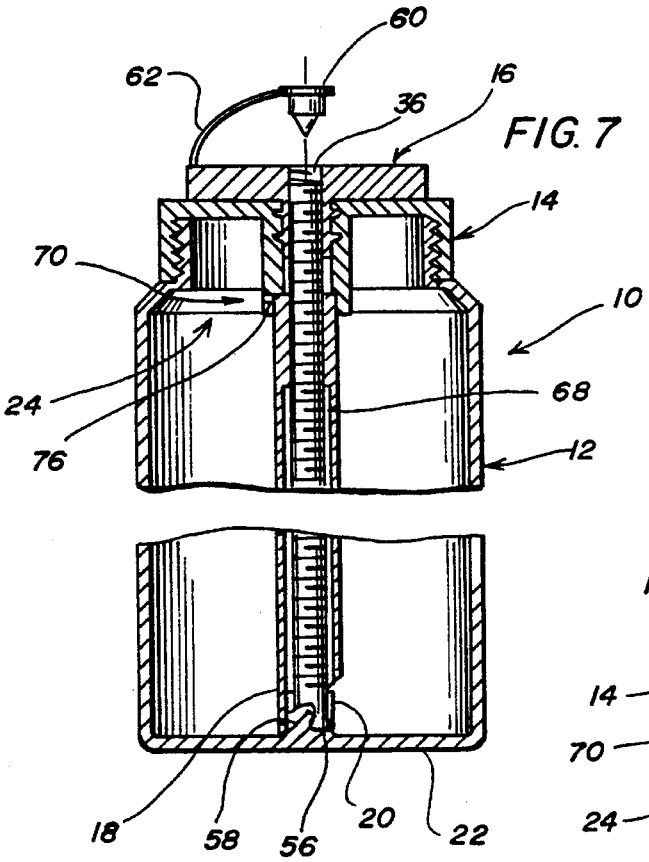
FIG. 7 is a sectional view of the drinking container with the inner straw retracted.
Figure 8:
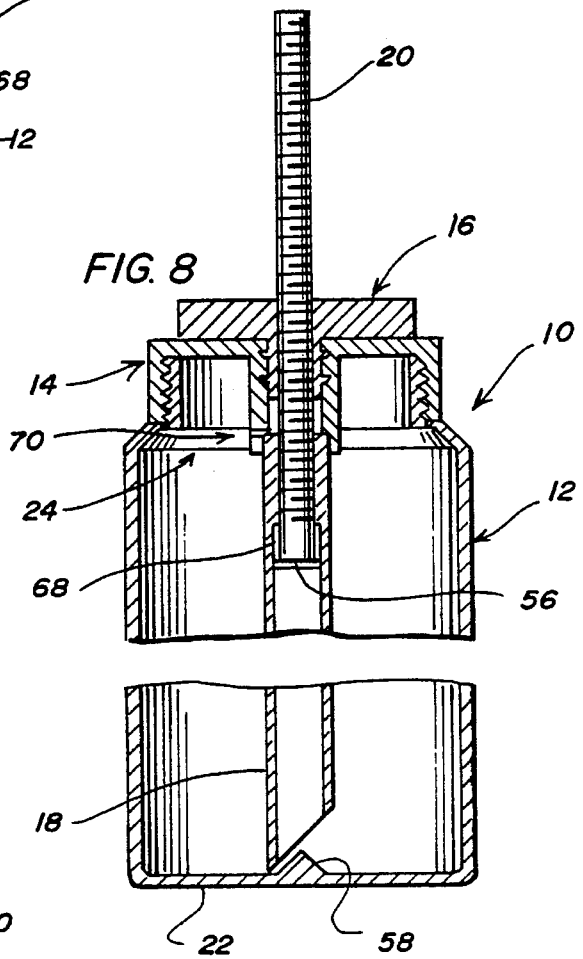
FIG. 8 is a sectional view of the drinking container with the inner straw extended and a first airway opened.

With reference to the drawings, in starting position, second straw 20 is retracted as shown in FIG. 7 with tip 56 seated on nub 58 and plug 60 inserted in orifice 36. Lid 14 is unscrewed from vessel 12 and liquid poured in. Lid 14 is then reattached to vessel 12. With second straw 20 retracted, airway 72 is closed such that no liquid can leak out of drinking container 10 even if it is laid on its side, turned upside down or shook so that drinking container 10 can be carried loose in a backpack, laid on a car seat, etc.

When a user wants a sip of the liquid, he simply pulls plug 60 out of orifice 36 and turns nut 16 in a direction causing second straw 20 to be raised out of first straw 18, opening airway 72. When tip 56 of second straw 20 reaches abutment shoulder 68, further upward movement is stopped, preventing unwanted removal of the straw from the container. As the user sips, air flows into vessel 12 through airway 72 filling vessel 12 as the liquid is displaced. After the user is done drinking, he turns nut 16 in the opposite direction until second straw 20 is retracted and airway 72 closed, reinserts plug 60 in orifice 36 rendering drinking container 10 leak proof.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A drinking container comprising:

a vessel with an open upper end and a closed lower end, a lid with a rim and top and bottom sides, a nut with a head and a shank and first and second telescoping straws;

said lid lockably engaged at the rim to said vessel upper end for sealing liquid within said vessel;

said lid having an orifice within which the shank of the nut is journaled with the head of the nut mounted on the top side of the lid;

said nut having a hole with threads passing through the shank and the head;

said first straw being attached to the bottom side of the lid in alignment with the orifice;

said second straw being smaller in diameter than the first straw and having exterior threads engaged with the threads in the hole of the nut;

whereby rotating the nut on the lid causes the second straw to slide longitudinally in the first straw.

2. The drinking container of claim 1 wherein the first and second straws have a longitudinal axis and the first straw has a longitudinal groove running substantially the length of the straw and the second straw has a lug received in the longitudinal groove of the first straw so that the second straw does not rotate with the nut.

3. The drinking container of claim 2 wherein a collar with a groove is attached to the orifice and the shank has an exterior ridge received in the groove of the collar, said first straw attached to the lid through the collar.

4. The drinking container of claim 3 wherein the first and second straws reach to the closed lower end of the vessel when the second straw is fully retracted.

5. A drinking container comprising:

a vessel with a closed lower end and an open upper end, a lid with a rim and top and bottom sides, a nut with a head and a shank and first and second telescoping straws;

said lid lockably engaged at the rim to said vessel upper end for sealing liquid within said vessel;

said lid having an orifice to which is attached a collar with a groove, said shank of the nut having an exterior ridge received in the groove of the collar and said head having top and bottom sides;

said nut journaled in the orifice with the head of the nut mounted on the top side of the lid;

said nut having a hole with threads passing through the shank and the head;

said first straw having a longitudinal axis and being attached to the collar in alignment with the orifice, said first straw reaching substantially to the closed lower end of the vessel and having at least one interior longitudinal groove running substantially the length of the straw;

said second straw having a longitudinal axis and being smaller in diameter than the first straw and having exterior threads engaged with the threads in the hole of the nut and at least one lug received in the longitudinal groove of the first straw so that the second straw does not rotate with the nut;

whereby rotating the nut on the lid causes the second straw to slide longitudinally in the first straw.

6. The drinking container of claim 5 wherein the lid has a second orifice serving as an airway and the head of the nut has a lobe blocking the second orifice when the second straw is retracted below the top surface of the nut.

7. The drinking container of claim 5 wherein the collar has a port and the second straw has an exterior longitudinal groove, beginning a distance below its upper end, said collar and second straw forming an airway when the port in the collar is aligned with the groove in the second straw, said collar and second straw forming an air seal when the second straw is retracted below the top surface of the nut and the port is aligned with the ungrooved portion of the upper end of the second straw.

* * * * *